US006003602A

United States Patent [19]

Wilkins

[11] Patent Number: 6,003,602

[45] Date of Patent: Dec. 21, 1999

[54] TREE BORE PROTECTOR

[75] Inventor: Robert Lee Wilkins, Houston, Tex.

[73] Assignee: Kraerner Oilfield Products, Houston, Tex.

[21] Appl. No.: 08/924,299

[22] Filed: Sep. 5, 1997

[51] Int. Cl.[6] ..... E21B 7/12

[52] U.S. Cl. ..... 166/339; 166/348; 166/368

[58] Field of Search ..... 166/334, 365, 166/368, 85.3, 348

[56] References Cited

U.S. PATENT DOCUMENTS

| | | | |
|---|---|---|---|
| 3,100,015 | 8/1963 | Regan | 166/85.3 |
| 3,163,220 | 12/1964 | Haeber et al. | 166/358 |
| 3,739,846 | 6/1973 | Beson | 166/89 |
| 3,965,977 | 6/1976 | Beson | 166/88 |
| 4,386,656 | 6/1983 | Fisher et al. | 166/117.5 |
| 4,703,774 | 11/1987 | Seehausen | 137/614 |
| 4,709,725 | 12/1987 | Morrison | 137/614 |
| 4,796,922 | 1/1989 | Prichard | 285/26 |
| 4,852,611 | 8/1989 | Knerr et al. | 137/595 |
| 5,560,436 | 10/1996 | Award et al. | 175/7 |
| 5,671,812 | 9/1997 | Bridges | 166/348 |
| 5,873,415 | 2/1999 | Edwards | 166/344 |

FOREIGN PATENT DOCUMENTS

| | | |
|---|---|---|
| 2097885 | 5/1981 | United Kingdom . |
| 2132728 | 7/1984 | United Kingdom . |
| 2184508 | 6/1987 | United Kingdom . |
| 2195158 | 3/1988 | United Kingdom . |

*Primary Examiner*—William Neuder
*Assistant Examiner*—Zakiya Walker
*Attorney, Agent, or Firm*—Wendy Buskop; Bayko Gibson et al.

[57] ABSTRACT

A subsea wellhead assembly comprises a subsea wellhead, a spool body assembly, a helix, and a tubular bore protector. The spool body assembly is mounted to the wellhead and has an inside surface defining a vertical bore. The spool body assembly has an upper end, a lower end, and a lateral production fluid outlet port. The helix is formed from a tubular member and is positioned in a lower portion of the spool body assembly. The helix has a generally cylindrical outer surface defining an outer diameter and a generally cylindrical inner surface defining an inner diameter, an upper end and a lower end. The tubular member has an organ pipe-shaped cut in the upper end so that the upper end is generally elliptically shaped and forms a pair of arcuate ramps to orient a tubing hanger. The tubular bore protector body has an upper end, a lower end, and a longitudinal axis. The tubular bore protector is mounted in the spool body assembly with the upper end of the tubular bore protector body being positioned adjacent to the upper end of the spool body assembly. The lower end of the tubular bore protector body is positioned adjacent to the lower end of the spool body assembly. The tubular bore protector body extends inside of the helix, to protect the vertical bore through the spool body assembly and the helix from mechanical damage while the well is being completed.

26 Claims, 10 Drawing Sheets

TREE BORE PROTECTOR

BACKGROUND OF THE INVENTION

This invention relates to completing subsea wellheads.

After a subsea well is drilled, but prior to the installation of what is commonly referred to as a horizontal or side valve tree type completion system, it is necessary to make the well safe before recovering the drilling Blowout Prevention Subsea Stack (BOP). In order to make the well safe, cement plugs or mechanical sealing plugs must be installed in the bore of the last casing string (production casing) of the wellhead, in order to prevent the possibility of hydrocarbons escaping to the subsea environment after removal of the BOP. After successful installation of the horizontal/side valve tree onto the wellhead, it is necessary to remove the downhole casing cement plug/s or mechanically set casing sealing plug/s. Cements plugs are removed by drilling out with standard downhole drill bits. Of course, these plug recovery operations require passing drill bits or special plug recovery tools through the side valve tree and could expose critical internal through bore profile features in the side valve tree to the following ramifications:

a. Mechanical damage as drill bit or special mechanical plug recovery tools pass through the side valve tree.

b. Mechanical damage due to drill pipe rotation during drilling.

c. Exposure of annulus, production, and control line side outlet penetrations to drilling muds and drilling returns which could clog up and impair the operation of the side valve tree critical side outlet valve and control functions. Additionally, drilling muds and returns might accumulate on the surface of the through bore profile and be very difficult to remove, which would in turn potentially prevent the successful installation of internal tubing hanger and/or tree cap.

d. Finally, it is desirable not to expose the side valve tree side outlet valve and control line bores to any hydraulic pressures resulting from the drilling operation which could result in pumping undesirable fluids into valve or control line porting.

One of the key benefits ascribed to horizontal/side valve tree type completions is the ability to recover or recomplete the well without having first to recover the horizontal/side valve tree. This provides the ability to recover the tubing hanger and downhole completion through the tree. This also provides the ability to perform additional drilling operations through the tree such as side-tracking into a different hydrocarbon formation which allows the same wellhead and tree to be used for recompleting the well from that different geological hydrocarbon formation. Side tracking requires even more extensive drilling through the horizontal/side valve tree with thus even greater potential for detrimental ramifications to the side valve tree internals as described above for drilling out cement plugs, should no type of protection be provided for the tree through bore.

All of the detrimental ramifications to the side valve tree internals described above during downhole/drilling operations can be prevented if a pressure containing tree bore protector is installed in the horizontal/side valve tree prior to performing any of the described downhole drilling operations. Such a bore protector would lockdown to the internal profile in the side valve tree while sealing off above and below critical internal profile features in the side valve tree such as: Annulus side outlets, Production bore side outlets, Control line side outlets, Tubing hanger and tree cap critical internal profile landing, lockdown, and orientation features.

Additionally, the bore protector should be designed to withstand and isolate the tree features from any expected formation or drilling pressures which might be encountered or applied as part of downhole drilling operations, while allowing passage of a drill bit through same. The internal bore diameter of the bore protector would be of a size equal to or greater than the inside diameter of the last casing string/production casing.

OBJECTS OF THE INVENTION

It is an object of this invention to provide a bore protector for a subsea horizontal christmas tree.

It is another object of this invention to provide a pressure containing tree bore protector to protect a through bore in a side valve tree from mechanical damage during recovery of tools or equipment.

It is another object of this invention to provide a pressure containing tree bore protector to protect outlets in a side valve tree from exposure to drilling fluids and hydraulic pressures during drilling operations.

SUMMARY OF THE INVENTION

In one embodiment of the invention, there is provided a bore protector. The bore protector is formed from a tubular bore protector body having an upper end, a lower end, a longitudinal axis, a radially movable lock means, and a longitudinally movable actuator means for actuating the radially movable lock means. A mounting means is mounted on the upper end of the tubular bore protector body for slidably mounting the actuator means for movement along the longitudinal axis of the tubular bore protector body from a first position to a second position and for positioning the lock means for radial movement upon urging by the actuator means. Movement of the actuator means from the first position to the second position urges the radially movable lock means radially outward from a first position to a second position.

In another embodiment of the invention, there is provided a subsea wellhead assembly. The assembly comprises a subsea wellhead, a spool body assembly, a helix, and a tubular bore protector. The spool body assembly is mounted to the wellhead and has an inside surface defining a vertical bore. The spool body assembly has an upper end, a lower end, and a lateral production fluid outlet port. The helix is formed from a tubular member and is positioned in a lower portion of the spool body assembly. The helix has a generally cylindrical outer surface defining an outer diameter and a generally cylindrical inner surface defining an inner diameter, an upper end and a lower end. The tubular member has an organ pipe-shaped cut in the upper end so that the upper end is generally elliptically shaped and forms a pair of arcuate ramps to orient a tubing hanger. The tubular bore protector body has an upper end, a lower end, and a longitudinal axis. The tubular bore protector is mounted in the spool body assembly with the upper end of the tubular bore protector body being positioned adjacent to the upper end of the spool body assembly. The lower end of the tubular bore protector body is positioned adjacent to the lower end of the spool body assembly. The tubular bore protector body extends inside of the helix, to protect the vertical bore through the spool body assembly and the helix from mechanical damage.

In another embodiment of the invention, there is provided a method for positioning a bore protector in a christmas tree to protect the bore. The method is carried out by lowering a tubular bore protector into a spool body assembly mounted on a wellhead below the surface of a body of water. The spool body assembly has an inside surface defining a vertical bore, an upper end, a lower end, and a lateral production fluid outlet port between the upper end and the lower end. A lower portion of the spool body assembly contains a helix formed from a tubular member having a generally cylindrical outer surface defining an outer diameter, a generally cylindrical inner surface defining an inner diameter, an upper end and a lower end. The helix has an organ pipe-shaped cut in the upper end so that the upper end is generally elliptically shaped to form a pair of arcuate ramps to orient a tubing hanger. The tubular bore protector has an upper end, a lower end, and a longitudinal axis and is lowered into the spool body assembly so that the upper end of the tubular bore protector is positioned adjacent to the upper end of the spool body assembly and the lower end of the tubular bore protector is positioned adjacent to the lower end of the spool body assembly. The tubular bore protector extends inside of the helix, to protect the vertical bore through the spool body assembly and the helix from mechanical damage.

DETAILED DESCRIPTION OF THE PREFERRED EMBODIMENTS

Figure 11:
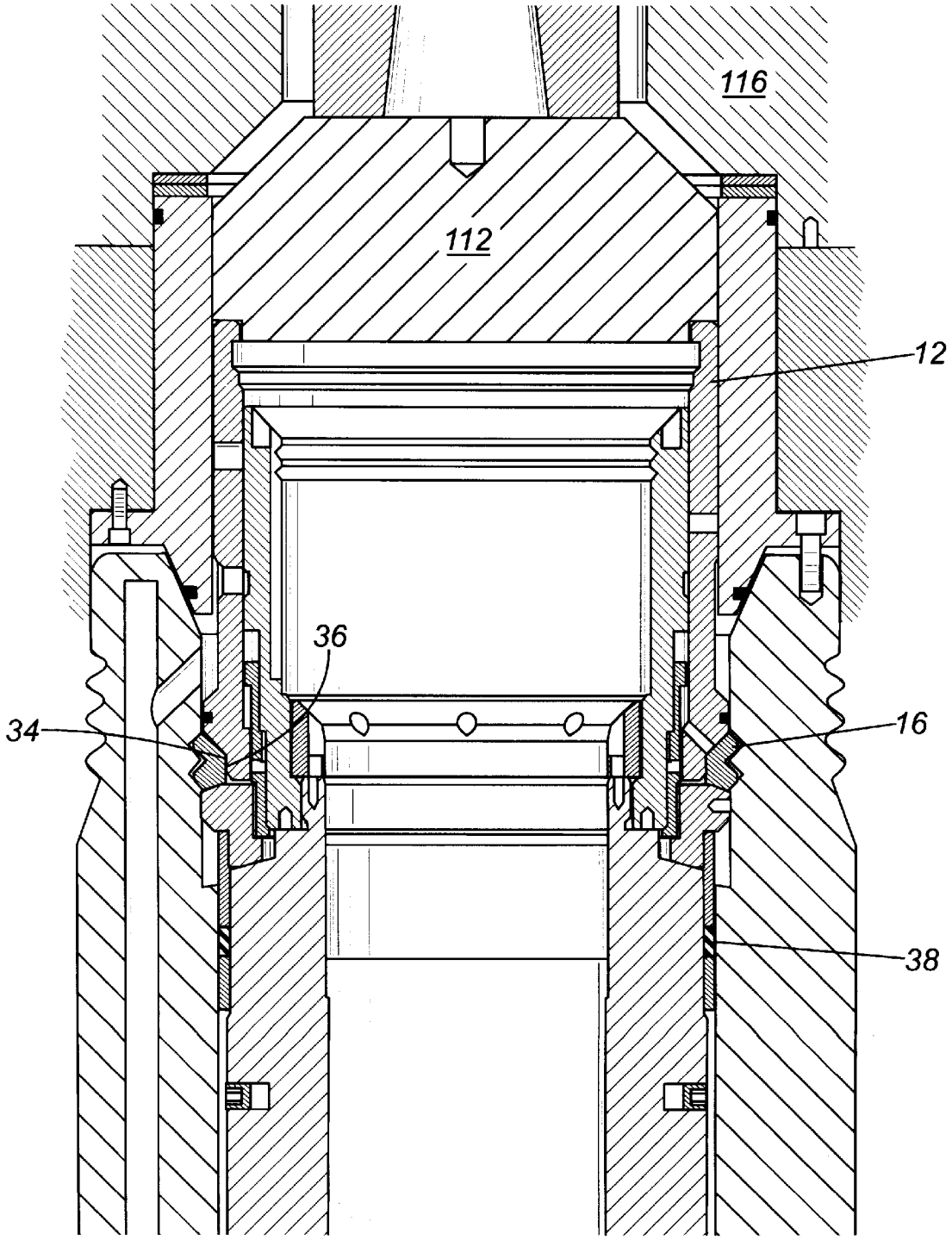
FIG. 11 is an enlarged view of a portion of the device shown in FIG. 7 with a tool installed to lock the spool protector into position in the spool body.

In one embodiment of the invention, there is provided a bore protector 2. The bore protector is formed from a tubular bore protector body 4 having an upper end, a lower end, and a longitudinal axis, a radially movable lock means 6, and a longitudinally movable actuator means 8 for actuating the radially movable lock means. A mounting means 10 is mounted on the upper end of the tubular bore protector body 4 for slidably mounting the actuator means 8 for movement along the longitudinal axis of the tubular bore protector body from a first position (FIG. 5) to a second position (FIG. 11) and for positioning the lock means 6 for radial movement upon urging by the actuator means. Movement of the actuator means 8 from the first position to the second position urges the radially movable lock means 6 radially outward from a first position (FIG. 5) to a second position (FIG. 11).

Figure 1:
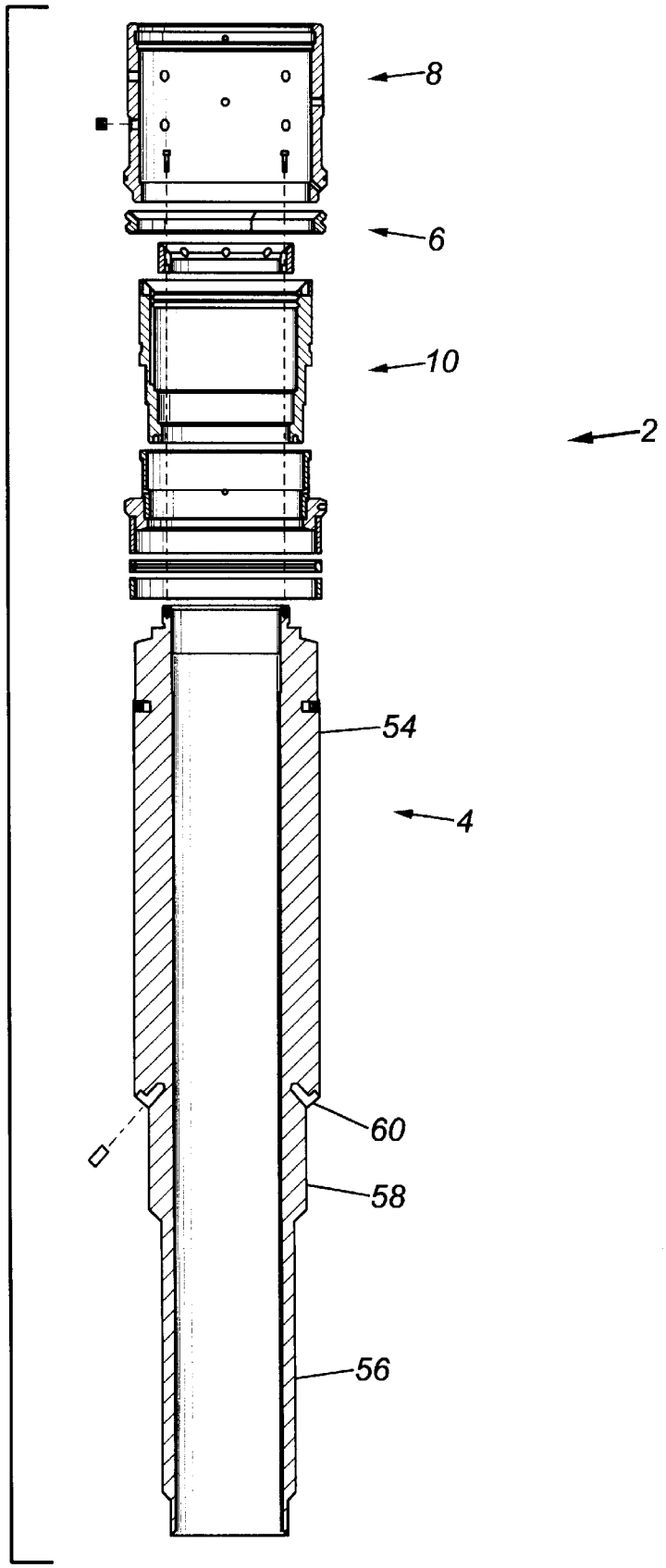
FIG. 1 is an exploded side-sectional view illustrating the bore protector of one embodiment of the present invention.
Figure 2:
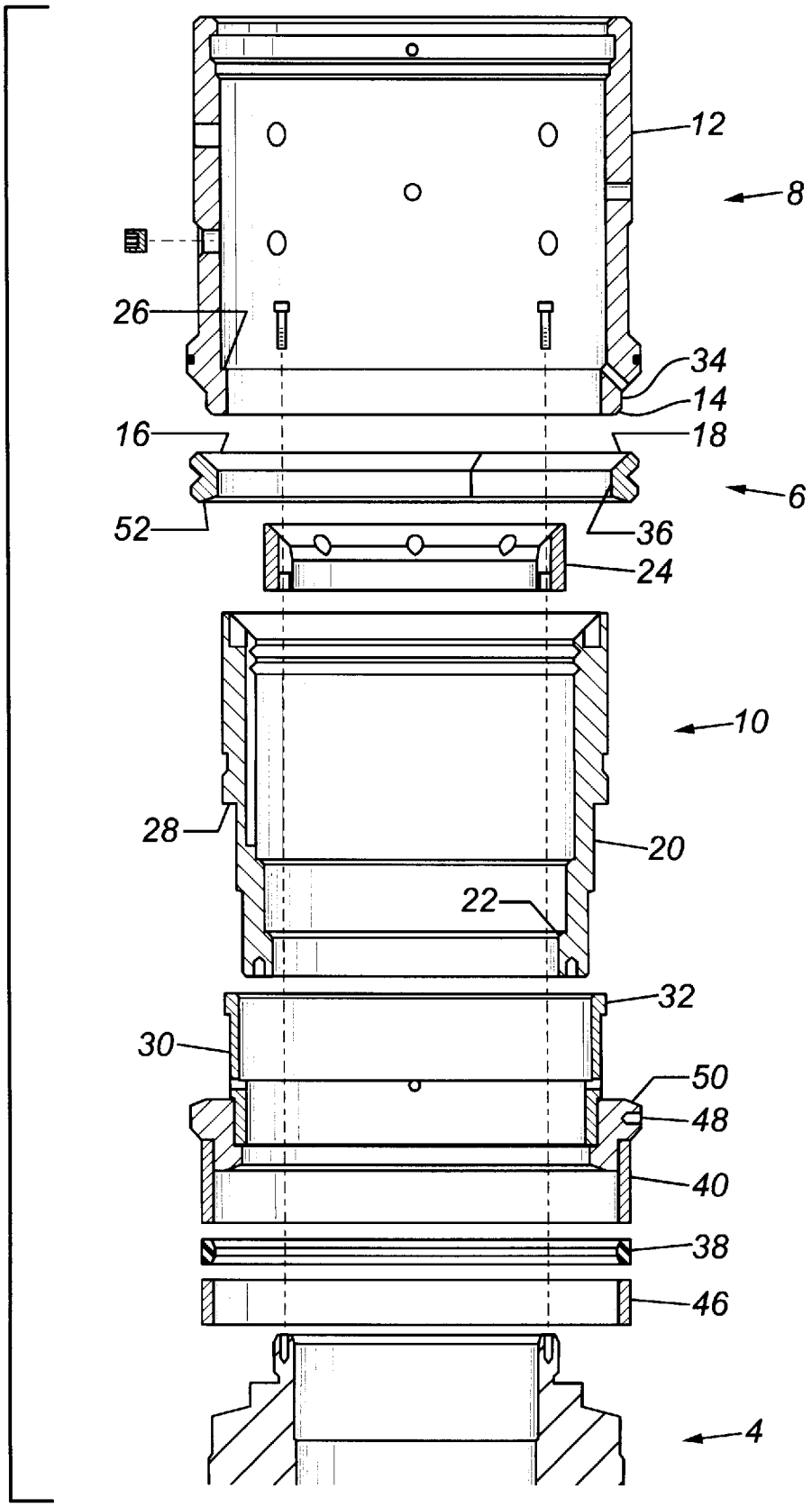
FIG. 2 is an enlarged view of the upper portion of the device shown in FIG. 1.
Figure 3:
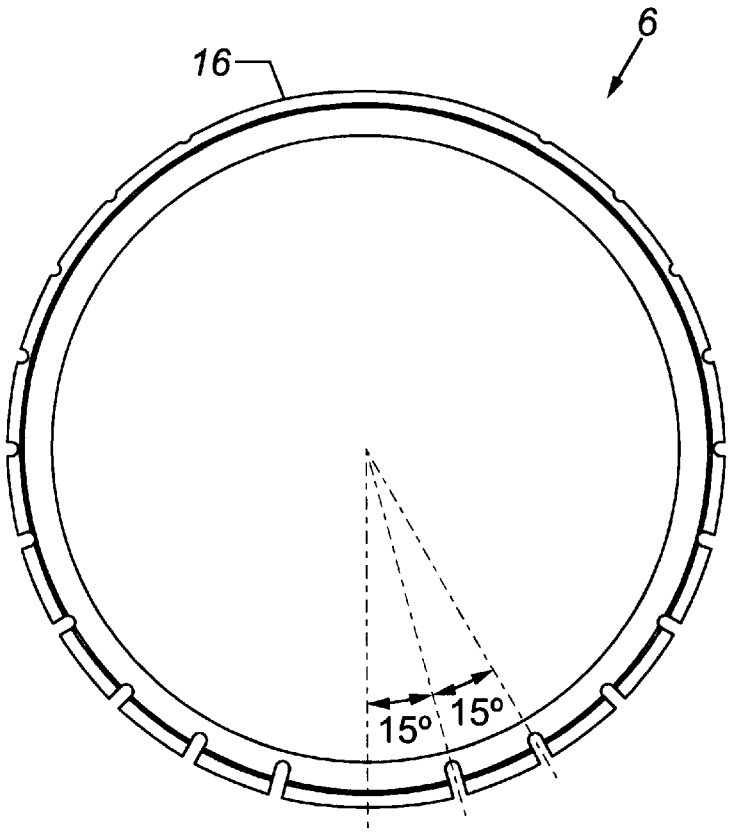
FIG. 3 is a plan view of the split locking ring shown in FIGS. 1 and 2.

The actuator means 8 preferably moves downwardly from the first position to the second position. In a preferred embodiment, the actuator means 8 is formed from a tubular actuator sleeve 12 having an upper end and a lower end with a radially outwardly and downwardly facing generally frustoconical surface 14 near the lower end. The lock means 6 is formed from a split expansion ring 16 circumferentially positioned around an outside surface of the means 10 for mounting the actuator means 12. The split expansion ring 16 has a radially inwardly and upwardly facing generally frustoconical surface 18 which faces the radially outwardly and downwardly facing generally frustoconical surface 14 near the lower end of the tubular actuator sleeve (See FIG. 2).

The radially outwardly and downwardly facing generally frustoconical surface 14 of the tubular actuator sleeve urges against the radially inwardly and upwardly facing generally frustoconical surface 18 of the split expansion ring as the tubular actuator sleeve 12 moves from the first position to the second position. This motion causes the expansion ring 16 to expand from the first outside diameter to the second outside diameter.

The mounting means 10 for slidably mounting the actuator means 12 is preferably formed from a tubular carrier body 20 having an upper end and a lower end with the lower end mounted to the upper end of the tubular bore protector 2. The sliding tubular actuator sleeve 12 and the split locking ring 16 are mounted to an outside surface of the tubular carrier body. The sliding tubular actuator sleeve 12 is positioned above the split locking ring 16 when the sliding tubular actuator sleeve is in the first position.

The tubular carrier body 20 preferably has an inwardly extending threaded annular flange 22 at its lower end which threads on to body 4. A carrier body hold down ring 24 positioned on an upper surface of the inwardly extending annular flange 22 to ensure that the inwardly extending annular flange 22 does not disengage from the tubular bore protector body 4.

The sliding tubular actuator 12 preferably has an upwardly facing generally annular shoulder 26 on a lower portion of its inner surface and the tubular carrier body 20 has a downwardly facing generally annular shoulder 28 on a midportion of its outer surface. A generally tubular spacer 30 is positioned between the tubular carrier body and the lower portion of the sliding tubular actuator. The generally tubular spacer 30 extends between the tubular carrier body 20 and the sliding tubular actuator 12. The generally tubular spacer 30 has an upper end positioned against the downwardly facing generally annular shoulder 28 of the carrier body 20 and a downwardly facing outwardly extending annular flange 32 adjacent to its upper end that rests against the annular shoulder 26 to retain the sliding tubular actuator 12 on the tubular carrier body 20.

The sliding tubular actuator 12 has a generally cylindrical outer surface 34 near its lower end positioned adjacent to and above its radially outwardly and downwardly facing generally frustoconical surface 14. The split locking 16 ring has a generally cylindrical inner surface 36 positioned adjacent to and below its radially inwardly and upwardly facing generally frustoconical surface 14. The generally cylindrical outer surface 34 of the sliding tubular actuator 12 is positioned against the generally cylindrical inner surface 36 of the split locking ring 16 when the sliding tubular actuator is in the second position to provide positive retention of the split locking ring in the second position. See FIG. 11.

In a further preferred embodiment, a generally ring-shaped elastomeric seal 38 is positioned around an outer surface of the generally tubular bore protector 2 adjacent to the upper end thereof The seal 38 is preferably expandable. For this purpose, a generally tubular actuator sleeve 40 is positioned above and adjacent to the generally ring-shaped elastomeric seal 38. An urging means 42 is provided for urging the generally tubular actuator sleeve 40 against the generally ring-shaped elastomeric seal 38 to cause a radial expansion of the generally ring-shaped elastomeric seal.

To facilitate expanding the seal, it is preferred that the outer surface of the generally tubular bore protector 2 has an outwardly and upwardly facing generally frustoconical surface 44 adjacent to the upper end thereof The generally ring-shaped elastomeric seal 38 is positioned adjacent to and above the outwardly and upwardly facing generally frustoconical surface. To limit downward movement of the seal when urged, it is preferred to provide a backer ring 46 positioned adjacent to the upper end of the generally tubular bore protector adjacent to and beneath the generally ring-shaped elastomeric seal.

In the illustrated embodiment of the invention, the urging means comprises a lower stop ring 48 for the split locking ring 16. The lower stop ring having an upwardly and outwardly facing generally frustoconical surface 50 which is contacted by a downwardly and inwardly facing generally frustoconical surface 52 of the split locking ring when the split locking ring is expanded to the second diameter to bias the lower stop ring 48 in the downward direction. The generally tubular actuator sleeve 40 extends between the lower stop ring 48 and the generally ring-shaped elastomeric seal 38 to transmit the downward bias from the lower stop ring to the generally ring-shaped elastomeric seal.

The generally tubular bore protector is preferably configured as to be closely received by a spool body. Preferably, the generally tubular bore protector 2 has a first generally cylindrical outer surface 54 near the upper end having a first diameter, a second generally cylindrical outer surface 56 near the lower end having a second diameter which is smaller than the first diameter, and a third generally cylindrical outer surface 58 between the first generally cylindrical surface and the second generally cylindrical outer surface having a third diameter which is between the first diameter and the second diameter. More preferably, the generally tubular bore protector has a generally frustoconically shaped downwardly facing shoulder 60 on its outer surface between the first generally cylindrical surface and the second generally cylindrical surface. A detent means 62 extends from the generally frustoconically shaped downwardly facing shoulder and acts as an anti-rotation means for use with the running tool.

Figure 4:
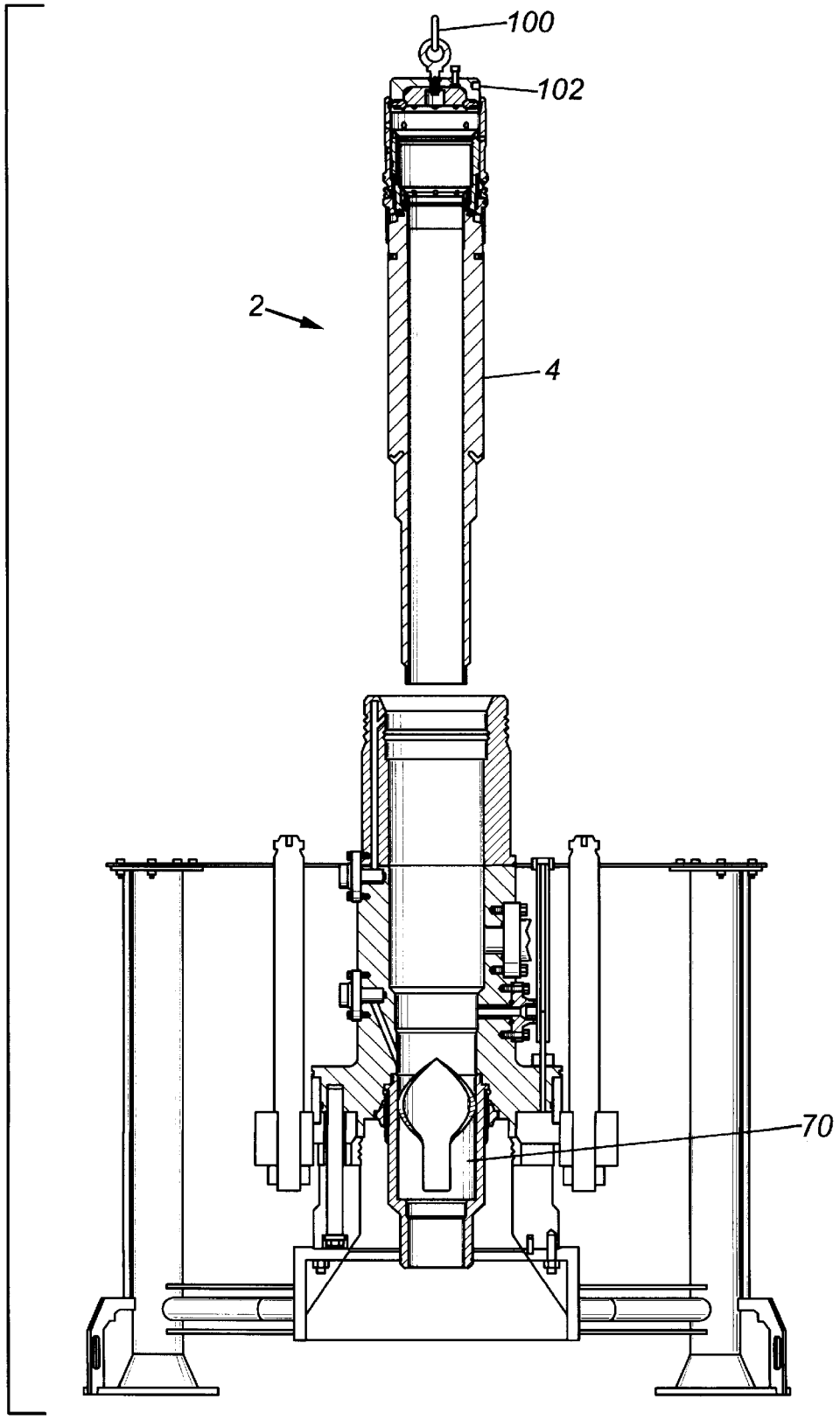
FIG. 4 is a side sectional view illustrating the assembled bore protector being lowered into a spool body.
Figure 6:
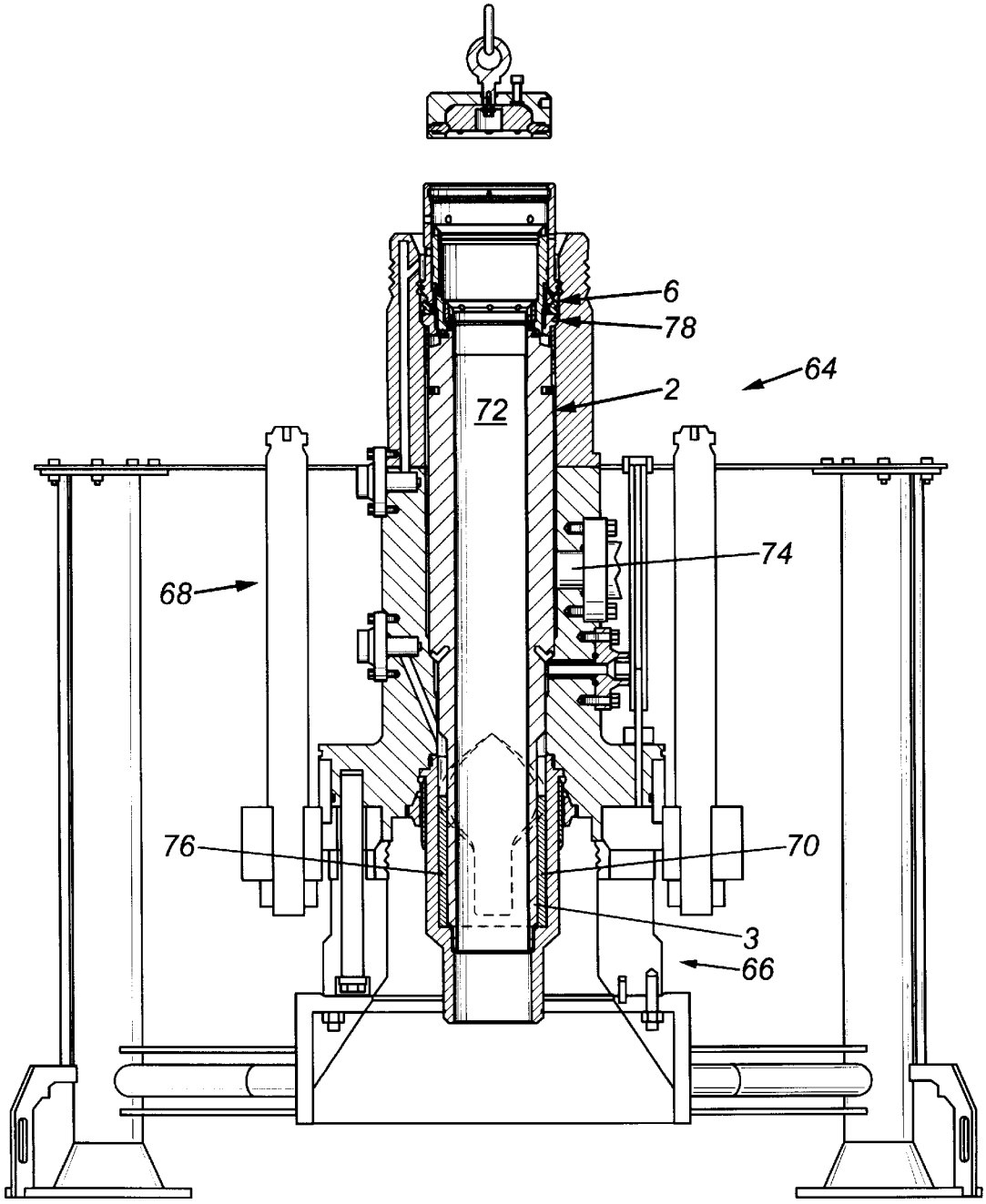
FIG. 6 is a side sectional view illustrating the bore protector positioned in an unlocked configuration in a spool body and the handling tool being removed.

In another embodiment of the invention, and with reference to FIGS. 4 and 6, there is provided a subsea wellhead assembly 64. The assembly comprises a subsea wellhead connector 66, a spool body assembly 68, a helix 70, and a tubular bore protector 2. The spool body assembly is mounted to the wellhead connector 66 and has an inside surface defining a vertical bore 72. The spool body assembly has an upper end, a lower end, and a lateral production fluid outlet port 74. The helix 70 is formed from a tubular member and is positioned in a lower portion of the spool body assembly. The helix has a generally cylindrical outer surface defining an outer diameter and a generally cylindrical inner surface defining an inner diameter, an upper end and a lower end. The helix has an organ pipe-shaped cut 76 in the upper end so that the upper end is generally elliptically shaped and forms a pair of arcuate ramps to orient a tubing hanger. The tubular bore protector body 4 has an upper end, a lower end, and a longitudinal axis. The tubular bore protector is mounted in the spool body assembly 68 with the upper end of the tubular bore protector body being positioned adjacent to the upper end of the spool body assembly. The lower end of the tubular bore protector body is positioned adjacent to the lower end of the spool body assembly. A portion 3 of the tubular bore protector body extends inside of the helix to protect the vertical bore through the spool body assembly and the helix from mechanical damage.

A radially movable lock means 6 is mounted adjacent to the upper end of the tubular bore protector body. A radially inwardly extending depression 78 is formed in the bore of the spool body assembly adjacent to the upper end of the spool body assembly which receives the radially movable lock means mounted on the tubular bore protector body to lock the tubular bore protector body in the spool body assembly. The radially movable lock means 6 preferably comprises a split lock ring as previously described and the radially inwardly extending depression preferably comprises an annular groove sized to receive the split lock ring. The split lock ring is preferably expandable from a first diameter which is less than a diameter of the bore of the spool body assembly to a second diameter which fills the annular groove. More preferably, and as illustrated, an outer surface of the split lock ring defines a circumferentially extending groove and an inner surface of the annular groove defines a circumferentially extending ridge which is received by the groove on the split lock ring.

Figure 10:
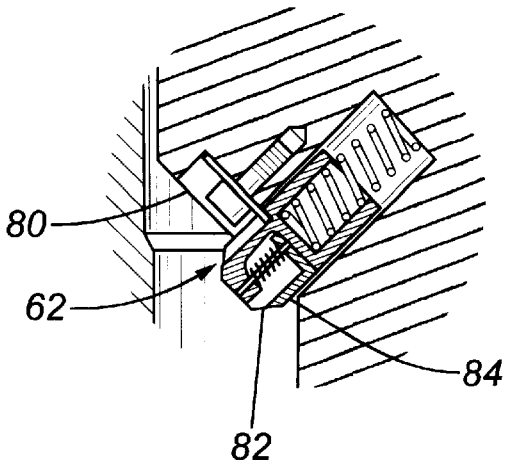
FIG. 10 is an enlarged view of a portion of the device shown in FIG. 9.
Figure 8:
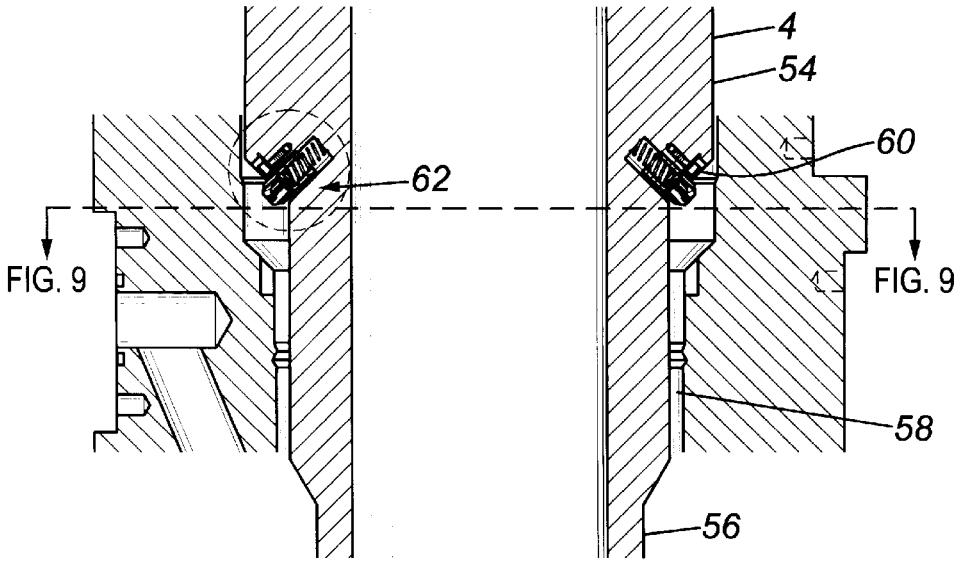
FIG. 8 is an enlarged view of a midportion of the device shown in FIG. 7.
Figure 9:
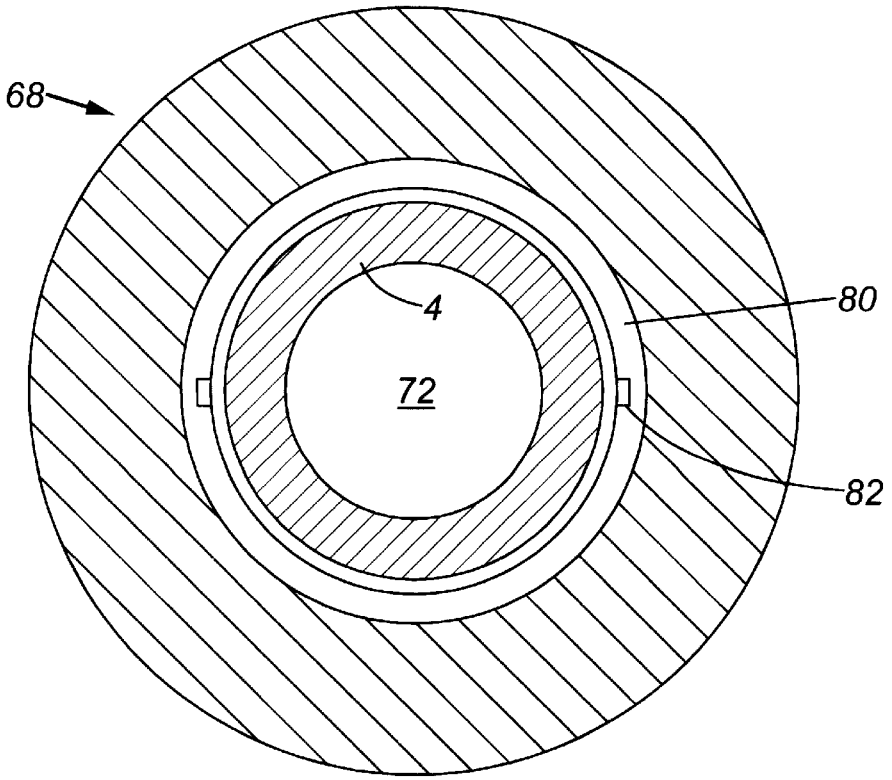
FIG. 9 is a cross-sectional view of the device taken along lines 9—9 of FIG. 8.

With reference to FIGS. 8, 9, and 10, the bore of the spool body assembly preferably defines an upwardly facing generally frustoconical tubing hanger surface 80 and the outer surface of the tubular bore protector defines a matching downwardly facing frustoconical surface 60 which is positioned against the tubing hanger surface. The generally frustoconical tubing hanger surface 80 defines a plurality of depressions 82 generally normal to the surface, and the matching frustoconical surface of the tubular bore protector has spring loaded detents 84 extending generally normally from such surface which are received by the depressions, one detent per depression.

Figure 7:
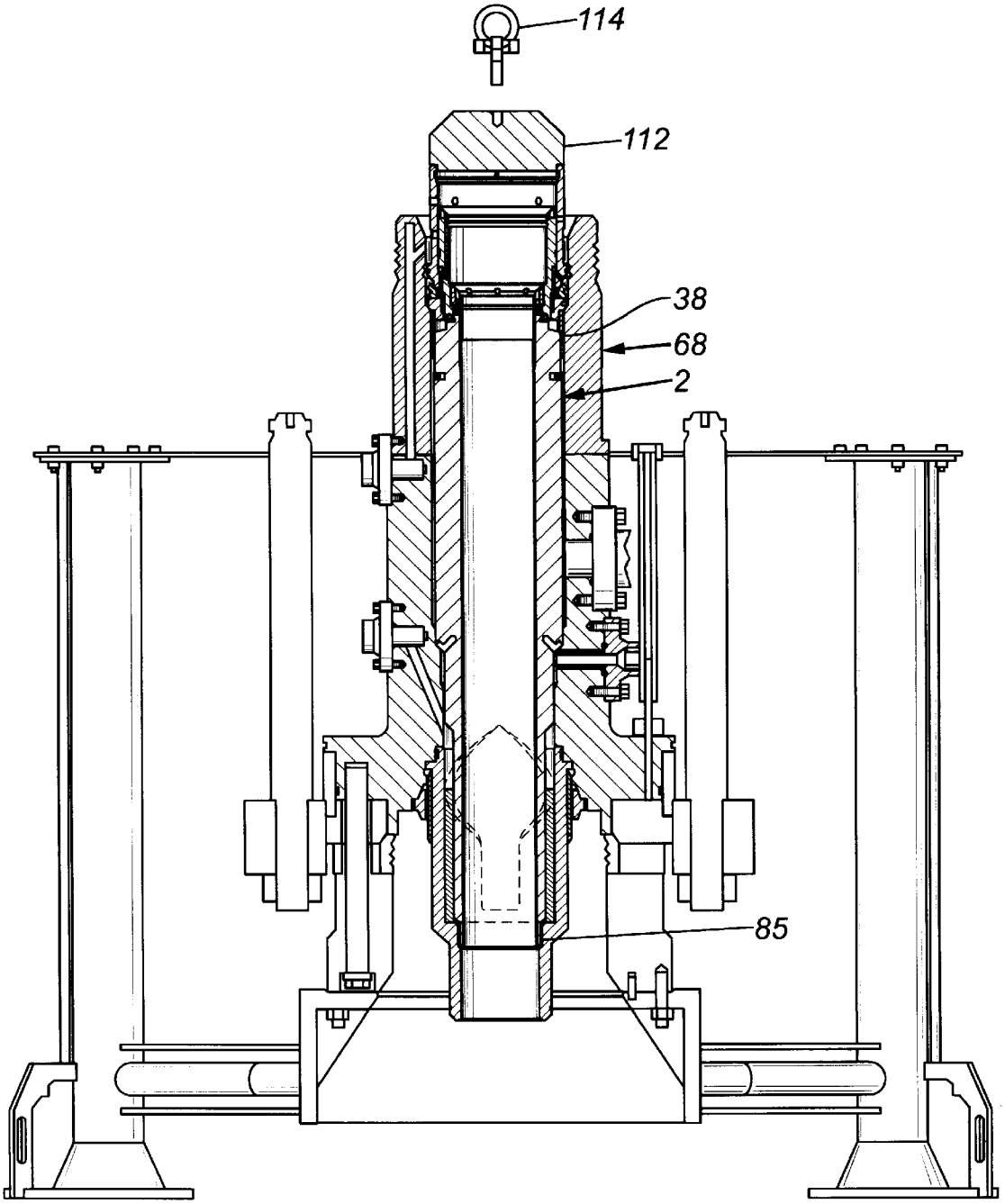
FIG. 7 is a side sectional view illustrating the bore protector positioned in an unlocked configuration in a spool body with a spacer installed at the upper end with an eye bolt being removed.

With reference to FIG. 7, a first elastomeric seal 38 is positioned generally circumferentially around an outer surface of the tubular bore protector 2 adjacent to the upper end of the bore protector and in sealing contact with both the outer surface of the tubular bore protector 2 and the bore of the spool tree assembly 68. A second elastomeric seal 85 is positioned generally circumferentially around an outer surface of the tubular bore protector adjacent to the lower end of the bore protector and in sealing contact with both the outer surface of the tubular bore protector and the bore of the spool body assembly.

In another embodiment of the invention, there is provided a method for positioning a bore protector in a christmas tree to protect the bore. The method is carried out by lowering a tubular bore protector into a spool body assembly mounted on a wellhead below the surface of a body of water. The spool body assembly has an inside surface defining a vertical bore, an upper end, a lower end, and a lateral production fluid outlet port between the upper end and the lower end. A lower portion of the spool body assembly contains a helix formed from a tubular member having a generally cylindrical outer surface defining an outer diameter, a generally cylindrical inner surface defining an inner diameter, an upper end and a lower end. The tubular member has an organ pipe-shaped cut in the upper end so that the upper end is generally elliptically shaped to form a pair of arcuate ramps to orient a tubing hanger. The tubular bore protector has an upper end, a lower end, and a longitudinal axis and is lowered into the spool body assembly so that the upper end of the tubular bore protector is positioned adjacent to the upper end of the spool body assembly and the lower end of the tubular bore protector is positioned adjacent to the lower end of the spool body assembly. The tubular bore protector extends inside of the helix, to protect the vertical bore through the spool body assembly and the helix from mechanical damage.

Figure 5:
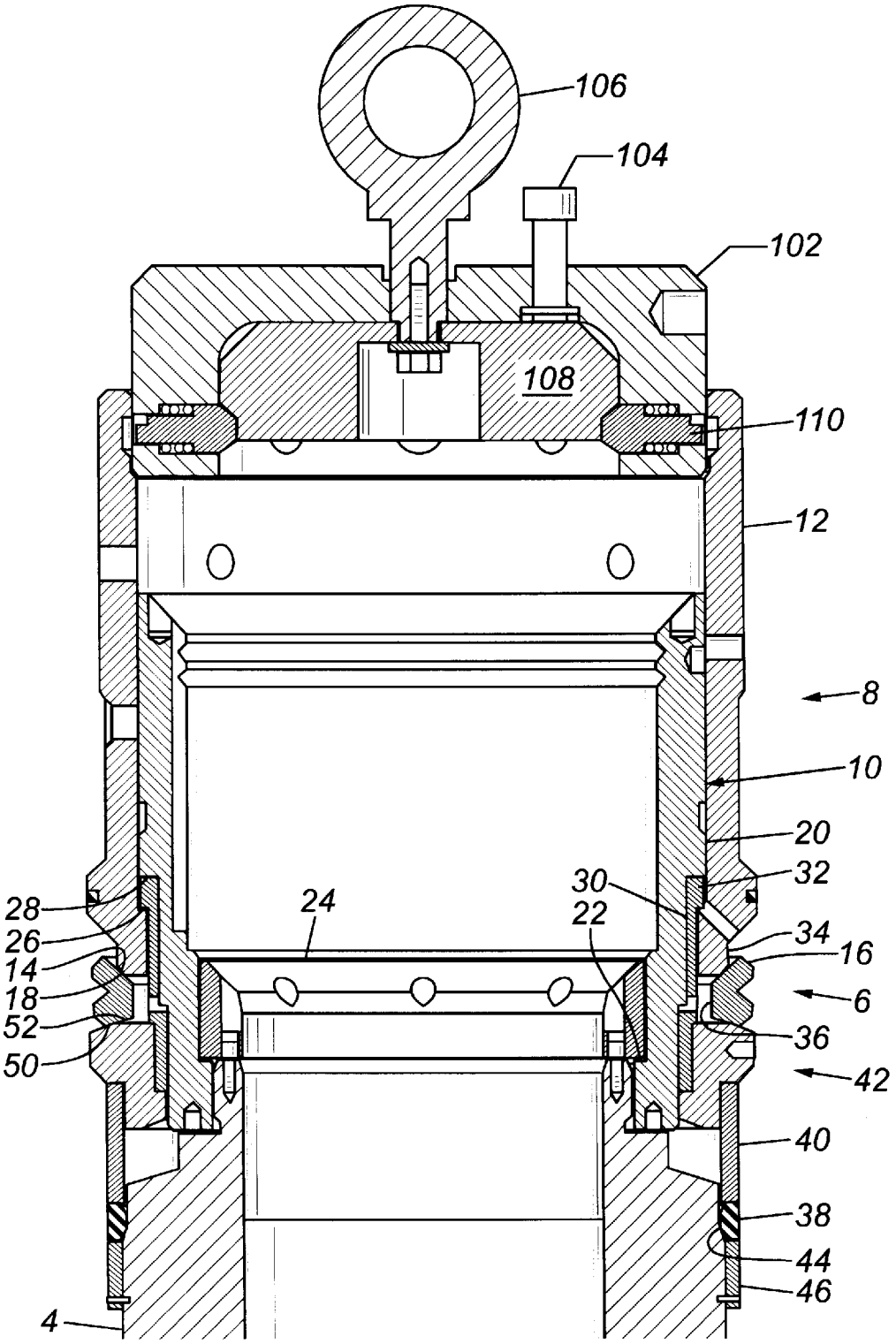
FIG. 5 is an enlarged view of the upper portion of the device shown in FIG. 4.

The method illustrated in FIGS. 4–7 relates to pre-installing the bore protector in the tree at the surface prior to the installation of the tree subsea. This allows the bore protector to be pre-installed in the tree. As shown in FIG. 4, the bore protector is preferably lowered into position using a cable 100 attached to a bore handling tool 102 attached to the upper end of the bore protector. The bore protector is then rotated until the detents engage with the depressions in the tubing hanger as shown in FIG. 8 to prevent further rotational movement. With reference to FIG. 5, locking bolt 104 is then loosened and eye bolt 106 rotated to retract shoe 108 upwardly. Lock dogs 110, which are spring loaded, then retract from their respective depressions in the bore protector, permitting the handling tool 102 to be removed.

With reference to FIG. 7, the previously removed handling tool is replaced with a bore protector spacer 112. An eye bolt 114, used to position the spacer, is then removed. A weight 116 is then positioned on the spacer 112, as shown in FIG. 11. The weight from weight 116 pushes down on the spacer 112, which in turn pushes down on the actuator 12 to expand the lock ring 16 into the locked position as well as to expand the seal 38 into sealing position with respect to the bore protector and the spool body.

Figure 12:
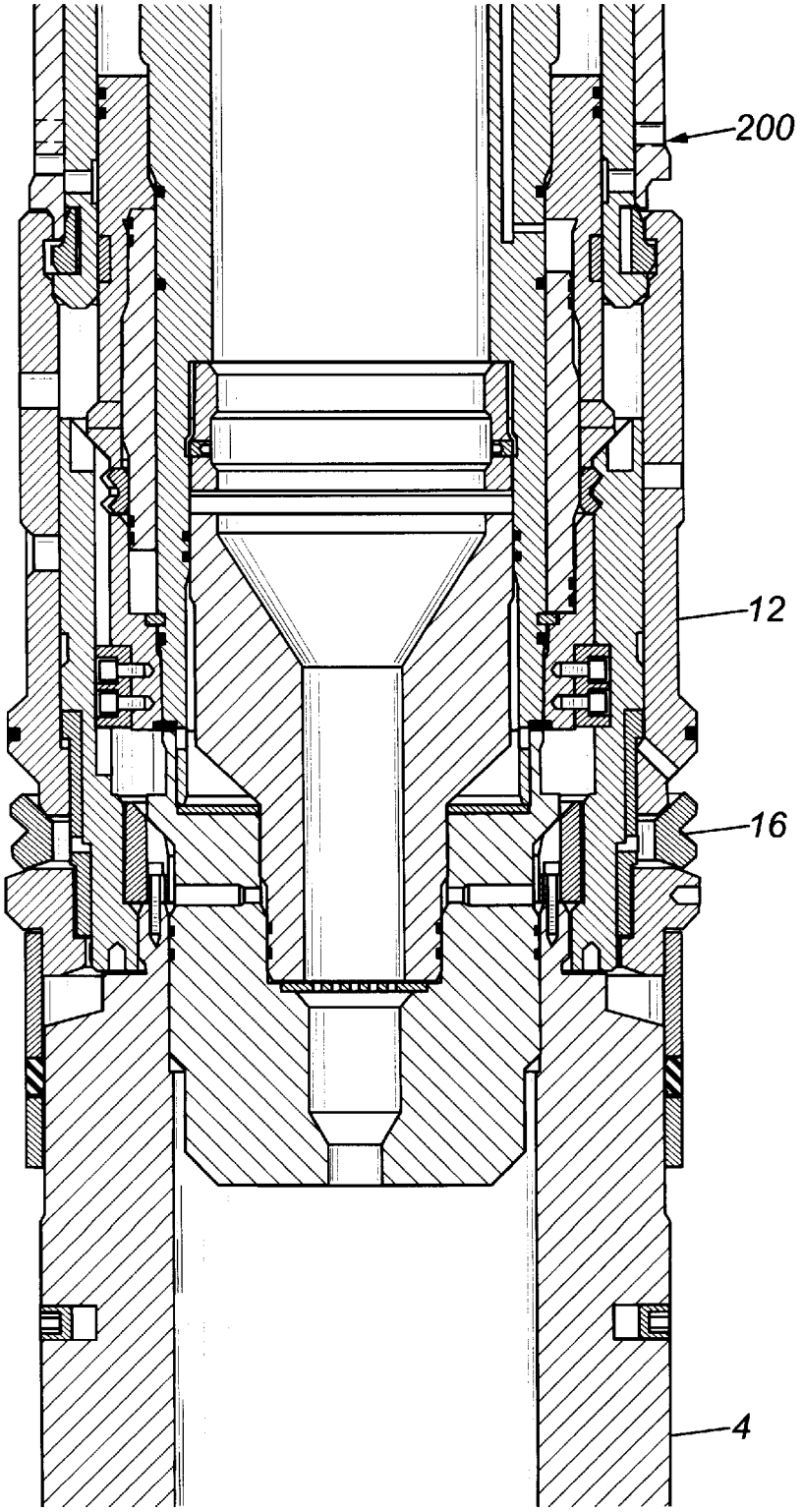
FIG. 12 is a side sectional view illustrating certain features of a tool which can be used to install and retrieve the bore protector. The left side of the Figure shows the tool positioned in an unlatched position on the bore protector, whereas the right side of the Figure shows the tool positioned in a latched configuration on the bore protector.

Preferably, the invention is installed and retrieved subsea, in the manner illustrated by FIG. 12. FIG. 12 shows a portion of a tool 200 which can be used to install and retrieve the bore protector 2. The tool 200 is lowered into an unlatched position on the bore protector as shown on the left side of the Figure. Further lowering of the tool 200 latches the tool onto the bore protector, as shown on the right side of the Figure. Raising the tool 200 then pulls up on the actuator sleeve, the locking ring retracts, and the bore protector can be removed from the spool body.

While certain preferred embodiments of the invention have been described herein, the invention is not to be construed as so limited, except to the extent that such limitations are found in the claims.

What is claimed is:

1. Apparatus comprising a tubular bore protector body having an upper end, a lower end, and a longitudinal axis;

a radially movable lock means;

a longitudinally movable actuator means for actuating the radially movable lock means;

a mounting means mounted on the upper end of the tubular bore protector body for slidably mounting the actuator means for movement along the longitudinal axis of the tubular bore protector body from a first position to a second position and for positioning the lock means for radial movement upon urging by the actuator means;

wherein movement of the actuator means from the first position to the second position urges the radially movable lock means radially outward from a first position to a second position.

2. Apparatus as in claim 1 wherein the actuator means moves downwardly from the first position to the second position.

3. Apparatus as in claim 2 wherein the actuator means comprises a tubular actuator sleeve having an upper end and a lower end with a radially outwardly and downwardly facing generally frustoconical surface near the lower end.

4. Apparatus as in claim 3 wherein the lock means comprises a split expansion ring circumferentially positioned around an outside surface of the means for mounting the actuator means, said split expansion ring having a radially inwardly and upwardly facing generally frustoconical surface which faces the radially outwardly and downwardly facing generally frustoconical surface near the lower end of the tubular actuator sleeve.

5. Apparatus as in claim 4 wherein the radially outwardly and downwardly facing generally frustoconical surface of the tubular actuator sleeve urges against the radially inwardly and upwardly facing generally frustoconical surface of the split expansion ring as the tubular actuator sleeve moves from the first position to the second position and causes the expansion ring to expand from a first outside diameter to a second outside diameter.

6. Apparatus as in claim 5 wherein the mounting means for slidably mounting the actuator means comprises a tubular carrier body having an upper end and a lower end with the lower end mounted to the upper end of the tubular bore protector, wherein the sliding tubular actuator sleeve and the split locking ring are mounted to an outside surface of the tubular carrier body, with the sliding tubular actuator sleeve being positioned above the split locking ring when the sliding tubular actuator sleeve is in the first position.

7. Apparatus as in claim 6 wherein the tubular carrier body has an inwardly extending annular flange at the lower end and is retained in position on the upper end of the tubular bore protector by a carrier body hold down ring positioned on an upper surface of the inwardly extending annular flange and bolted to the upper end of the tubular bore protector.

8. Apparatus as in claim 6 wherein the sliding tubular actuator sleeve has an upwardly facing generally annular shoulder on a lower portion of its inner surface and the tubular carrier body has a downwardly facing generally annular shoulder on a midportion of its outer surface, said apparatus further comprising a generally tubular spacer positioned between the tubular carrier body and the lower portion of the sliding tubular actuator sleeve, said generally tubular spacer extending between the tubular carrier body and the split locking ring, said generally tubular spacer having an upper end positioned against the downwardly facing generally annular shoulder of the carrier body and a downwardly facing outwardly extending annular flange adjacent to its upper end to retain the sliding tubular actuator sleeve on the tubular carrier body.

9. Apparatus as in claim 5 wherein the sliding tubular actuator sleeve has a generally cylindrical outer surface near its lower end positioned adjacent to and above its radially outwardly and downwardly facing generally frustoconical surface, and the split locking ring has a generally cylindrical inner surface positioned adjacent to and below its radially inwardly and upwardly facing generally frustoconical surface;

wherein the generally cylindrical outer surface of the sliding tubular actuator sleeve is positioned against the generally cylindrical inner surface of the split locking ring when the sliding tubular actuator sleeve is in the second position to provide positive retention of the split locking ring in the second position.

10. Apparatus as in claim 9 further comprising a generally ring-shaped elastomeric seal positioned around an outer surface of the generally tubular bore protector adjacent to the upper end thereof.

11. Apparatus as in claim 10 further comprising a generally tubular actuator sleeve positioned above and adjacent to the generally ring-shaped elastomeric seal; and urging means for urging the generally tubular actuator sleeve against the generally ring-shaped elastomeric seal to cause a radial expansion of the generally ring-shaped elastomeric seal.

12. Apparatus as in claim 11 wherein the outer surface of the generally tubular bore protector has an outwardly and upwardly facing generally frustoconical surface adjacent to the upper end thereof and the generally ring-shaped elastomeric seal is positioned adjacent to and above the outwardly and upwardly facing generally frustoconical surface.

13. Apparatus as in claim 12 further comprising a backer ring positioned adjacent to the upper end of the generally tubular bore protector adjacent to and beneath the generally ring-shaped elastomeric seal to limit downward movement of the generally ring-shaped elastomeric seal upon urging by the urging means.

14. Apparatus as in claim 13 wherein the urging means comprises a lower stop ring for the split locking ring, said lower stop ring having an upwardly and outwardly facing generally frustoconical surface which is contacted by a downwardly and inwardly facing generally frustoconical surface of the split locking ring when the split locking ring is expanded to the second diameter to bias the lower stop ring in the downward direction;

wherein the generally tubular actuator sleeve extends between the lower stop ring and the generally ring-shaped elastomeric seal to transmit the downward bias from the lower stop ring to the generally ring-shaped elastomeric seal.

15. Apparatus as in claim 1 wherein the generally tubular bore protector has a first generally cylindrical outer surface near the upper end having a first diameter, a second generally cylindrical outer surface near the lower end having a second diameter which is smaller than the first diameter, and a third generally cylindrical outer surface between the first generally cylindrical surface and the second generally cylindrical outer surface having a third diameter which is between the first diameter and the second diameter.

16. Apparatus as in claim 15 wherein the generally tubular bore protector has a generally frustoconically shaped downwardly facing shoulder on its outer surface between the first generally cylindrical surface and the second generally cylindrical surface, said apparatus further comprising detent means extending from the generally frustoconically shaped downwardly facing shoulder.

17. Apparatus comprising a subsea wellhead;

a spool body assembly having an inside surface defining a vertical bore extending therethrough, an upper end and a lower end, and having at least a lateral production fluid outlet port, said spool body assembly mounted to the subsea wellhead;

a helix comprising a tubular member having a generally cylindrical outer surface defining an outer diameter and a generally cylindrical inner surface defining an inner diameter, an upper end and a lower end, wherein said tubular member has an organ pipe-shaped cut in the upper end so that the upper end is generally elliptically shaped to form a pair of arcuate ramps to orient a tubing hanger, said helix being positioned in a lower portion of the spool body assembly;

a tubular bore protector body having an upper end, a lower end, and a longitudinal axis mounted in the spool body assembly, with the upper end of the tubular bore protector body being positioned adjacent to the upper end of the spool body assembly and the lower end of the tubular bore protector body being positioned adjacent to the lower end of the spool body assembly, said tubular bore protector body extending inside of the helix, to protect the vertical bore through the spool body assembly and the helix from mechanical damage.

18. Apparatus as in claim 17 further comprising a radially movable lock means mounted adjacent to the upper end of the tubular bore protector body, and a radially inwardly extending depression formed in the bore of the spool body assembly adjacent to the upper end of the spool body assembly which receives the radially movable lock means mounted on the tubular bore protector body to lock the tubular bore protector body in the spool body assembly.

19. Apparatus as in claim 18 wherein the radially movable lock means comprises a split lock ring, and the radially inwardly extending depression comprises an annular groove sized to receive the split lock ring, and the split lock ring is expandable from a first diameter which is less than a diameter of the bore of the spool body assembly to a second diameter which fills the annular groove.

20. Apparatus as in claim 19 wherein an outer surface of the split lock ring defines a circumferentially extending groove and an inner surface of the annular groove defines a circumferentially extending ridge which is received by the groove on the split lock ring.

21. Apparatus as in claim 19 wherein the bore of the spool body assembly defines an upwardly facing generally frustoconical tubing hanger surface and the outer surface of the tubular bore protector defines a matching downwardly facing frustoconical surface which is positioned against the tubing hanger surface.

22. Apparatus as in claim 21 wherein the generally frustoconical tubing hanger surface defines a plurality of depressions generally normal to the surface, and the matching frustoconical surface of the tubular bore protector has spring loaded detents extending generally normally from such surface which are received by the depressions, one detent per depression.

23. Apparatus as in claim 19 further comprising a first elastomeric seal positioned generally circumferentially around an outer surface of the tubular bore protector adjacent to the upper end of the bore protector and in sealing contact with both the outer surface of the tubular bore protector and the bore of the spool body assembly and a second elastomeric seal positioned generally circumferentially around an outer surface of the tubular bore protector adjacent to the lower end of the bore protector and in sealing contact with both the outer surface of the tubular bore protector and the bore of the spool body assembly.

24. A method comprising:

lowering a tubular bore protector into a spool body assembly mounted on a wellhead below the surface of a body of water;

wherein the spool body assembly has an inside surface defining a vertical bore extending therethrough, an upper end and a lower end, and a lateral production fluid outlet port between the upper end and the lower end, wherein a lower portion of the spool body assembly contains a helix comprising a tubular member having a generally cylindrical outer surface defining an outer diameter and a generally cylindrical inner surface defining an inner diameter, an upper end and a lower end, wherein said tubular member has an organ pipe-shaped cut in the upper end so that the upper end is generally elliptically shaped to form a pair of arcuate ramps to orient a tubing hanger;

wherein the tubular bore protector has an upper end, a lower end, and a longitudinal axis and is lowered into the spool body assembly so that the upper end of the tubular bore protector is positioned adjacent to the upper end of the spool body assembly and the lower end of the tubular bore protector is positioned adjacent to the lower end of the spool body assembly, and the tubular bore protector extends inside of the helix, to protect the vertical bore through the spool body assembly and the helix from mechanical damage.

25. A method as in claim 24 further comprising engaging a plurality of spring loaded detents positioned on an outside surface of the tubular bore protector with depressions formed on an inside surface of the spool body assembly to lock the tubular bore protector into the spool body assembly and prevent rotational movement.

26. A method as in claim 24 further comprising expanding an elastomeric ring seal mounted on an outside surface of an upper portion of the tubular bore protector into contact with an inside surface of an upper portion of the spool body assembly to form a seal between the tubular bore protector and the spool body assembly.

* * * * *